US005517212A

United States Patent [19]

Inoue

[11] Patent Number: 5,517,212

[45] Date of Patent: May 14, 1996

[54] CONTRAST ADJUSTMENT CIRCUIT FOR LIQUID CRYSTAL DISPLAY

[75] Inventor: Shuichi Inoue, Kawasaki, Japan

[73] Assignee: Fujitsu Limited, Kawasaki, Japan

[21] Appl. No.: 284,243

[22] Filed: Aug. 2, 1994

[30] Foreign Application Priority Data

Nov. 10, 1993 [JP] Japan ..... 5-280942

[51] Int. Cl.[6] ..... G09G 5/00

[52] U.S. Cl. ..... 345/211; 345/89; 345/212

[58] Field of Search ..... 345/211, 212, 345/213, 147, 148, 149, 89, 87, 98, 99, 100

[56] References Cited

U.S. PATENT DOCUMENTS

| | | | |
|---|---|---|---|
| 4,141,002 | 2/1979 | Reinhold | 345/211 |
| 4,348,666 | 9/1982 | Ogita | 345/147 |
| 4,427,978 | 1/1984 | Williams | 345/147 |
| 4,570,115 | 2/1986 | Misawa et al. | 345/212 |
| 4,769,639 | 9/1988 | Kawamura et al. | 345/89 |
| 5,229,761 | 7/1993 | Fuse | 345/211 |

*Primary Examiner*—Richard Hjerpe
*Assistant Examiner*—Xiao M. Wu
*Attorney, Agent, or Firm*—Armstrong, Westerman, Hattori, McLeland & Naughton

[57] ABSTRACT

A contrast adjustment circuit for a liquid crystal display which is connected, when to be used, to an electronic apparatus such as a computer. The contrast adjustment circuit comprises an adjustment voltage supply circuit provided in an electronic apparatus, a reference voltage generation circuit provided in the liquid crystal display for generating a reference voltage substantially equal in absolute value to a contrast peak voltage of the liquid crystal display, and an operational amplifier for comparing the reference voltage and an adjustment voltage and supplying a voltage difference between the reference voltage and the adjustment voltage to a driving voltage input terminal of the liquid crystal display.

7 Claims, 4 Drawing Sheets

CONTRAST ADJUSTMENT CIRCUIT FOR LIQUID CRYSTAL DISPLAY

BACKGROUND OF THE INVENTION

1. Field of the Invention

This invention relates to a contrast adjustment circuit for a liquid crystal display (LCD).

2. Description of the Related Art

An LCD is a device generally constructed such that a pair of transparent conductive films (electrodes) between which liquid crystal is enclosed are held between a pair of glass plates and a driving voltage is applied to the transparent conductive films to change the arrangement or the phase of molecules of the liquid crystal by an action of an electric field to change the amount of light passing through the liquid crystal to make a display. Such LCDs are utilized frequently as display devices for computers or like apparatus, which will be hereinafter referred to as electronic apparatus, and the adjustment of the contrast (degree of the difference in brightness between a brightest portion and a darkest portion of a screen) of an LCD is performed by finely adjusting a variable resistor of a contrast adjustment circuit from an electronic apparatus. The present invention is directed to such a contrast adjustment circuit for an LCD as described just above.

FIG. 1 is a circuit diagram showing a prior art. Referring to FIG. 1, reference numeral 1 denotes an electronic apparatus such as a computer, and 2 a liquid crystal display having an LCD panel 3. The electronic apparatus 1 includes a first power source (V1) 4 and a second power source (V2) 5 which are connected to each other by way of a plurality of voltage dividing resistors 6, 6 and 7. The resistor 7 is formed as a variable resistor, and an output terminal at an end of the variable resistor 7 is connected to a connection terminal 8 to the liquid crystal display module 2.

The liquid crystal display module 2 includes a transistor 9. The base terminal of the transistor 9 is connected to the connection terminal 8; the emitter terminal is connected to the first power source 4 supplied from the electronic apparatus 1 by way of a plurality of voltage dividing resistors 10; and the collector terminal is connected to the second power source 5 supplied from the electronic apparatus 1. The emitter terminal of the transistor 9 is connected to a corresponding one of a plurality of driving voltage input terminals of a control IC (not shown) of the LCD panel 3, and also output terminals at one ends of the individual voltage dividing resistors 10 are connected to corresponding ones of the driving voltage input terminals of control IC. Driving voltages $V_{LCD(1)}, \ldots, V_{LCD(n-1)}, V_{LCD(n)}$ are selectively supplied to the electrodes (transparent conductive films) of the LCD panel 3 under the control of the control IC.

The variable resistor 7 of the electronic apparatus 1 is adjusted finely to adjust the driving voltage $V_{LCD}$ (for example, −20 V) to the LCD panel 3 within a predetermined range (for example, the range of ±2 V) in order to adjust the contrast of the LCD panel 3. It is to be noted that a contrast adjustment circuit is constituted from the first power source 4, the second power source 5, the voltage dividing resistors 6, 6 and 7 including the variable resistor 7, and the transistor 9.

FIG. 2 is a diagram illustrating the relationship between the contrast and the driving voltage ($V_{LCD}$) of an LCD. By finely adjusting the variable resistor 7, the contrast is adjusted within a contrast range (indicated by "a" in FIG. 2) and normally set within an optimum contrast range indicated by b in FIG. 2 when the LCD is used. It is to be noted that the point c or d in FIG. 2 indicates a point at which the white or black display becomes a same color as the color of the background of the LCD panel, and in FIG. 2, the driving voltage $V_{LCD}$ is −18 V and −22 V at the points c and d, respectively. Meanwhile, the point e indicates a point at which the difference in brightness exhibits a maximum value (the driving voltage then is called contrast peak voltage).

By the way, in recent years, there is a tendency that LCD panels provided from different makers are connected, when to be used, compatibly to an electronic apparatus, and since LCD panels have different optimum contrast voltages depending upon the material of liquid crystal employed or some other factor, a conventional contrast adjustment circuit cannot perform adjustment of the contrast within an optimum contrast range, or else, the construction of the contrast adjustment circuit must be modified so as to conform to the contrast peak voltage of an LCD panel to be employed. Accordingly, the conventional contrast adjustment circuit is disadvantageous in that it lacks in flexibility.

SUMMARY OF THE INVENTION

It is therefore an object of the present invention to provide a contrast adjustment circuit for a liquid crystal display which always allows optimum contrast adjustment irrespective of the contrast peak voltage of a liquid crystal display used.

In accordance with an aspect of the present invention, there is provided a contrast adjustment circuit for a liquid crystal display which is connected to an electronic apparatus when to be used and has a driving voltage input terminal, comprising adjustment voltage supply means provided in the electronic apparatus and having voltage adjustment means for finely adjusting an adjustment voltage to be outputted, reference voltage generation means provided in the liquid crystal display for generating a reference voltage substantially equal in absolute value to a contrast peak voltage of the liquid crystal display, the reference voltage being capable of being adjusted in response to the contrast peak voltage of the liquid crystal display, and operational amplification means for comparing the reference voltage and the adjustment voltage and applying a voltage difference between the reference voltage and the adjustment voltage to the driving voltage input terminal of the liquid crystal display, the operational amplification means having a reverse phase input terminal to which the reference voltage from the reference voltage generation means is applied and a positive phase input terminal to which the adjustment voltage from the adjustment voltage supply means is applied.

The adjustment voltage supply means includes a first power source, a second power source having a potential different from that of the first power source, and a plurality of voltage dividing resistors connected in series between the first and second power sources, and the voltage adjustment means includes a variable resistor. The reference voltage generation means includes a first power source, a second power source having a potential different from that of the first power source, and a plurality of voltage dividing resistors connected in series between the first and second power sources.

According to the present invention, the driving voltage for the liquid crystal display can be varied within the range adjusted by the voltage adjustment means with reference to the contrast peak voltage of the liquid crystal display used.

Accordingly, since the contrast can be adjusted with reference to the contrast peak voltage of the liquid crystal display used irrespective of the contrast peak voltage, good contrast adjustment can always be achieved.

The above and other objects, features and advantages of the present invention and the manner of realizing them will become more apparent, and the invention itself will best be understood, from a study of the following description and appended claims with reference to the attached drawings showing some preferred embodiments of the invention.

DESCRIPTION OF THE PREFERRED EMBODIMENTS

Figure 1:
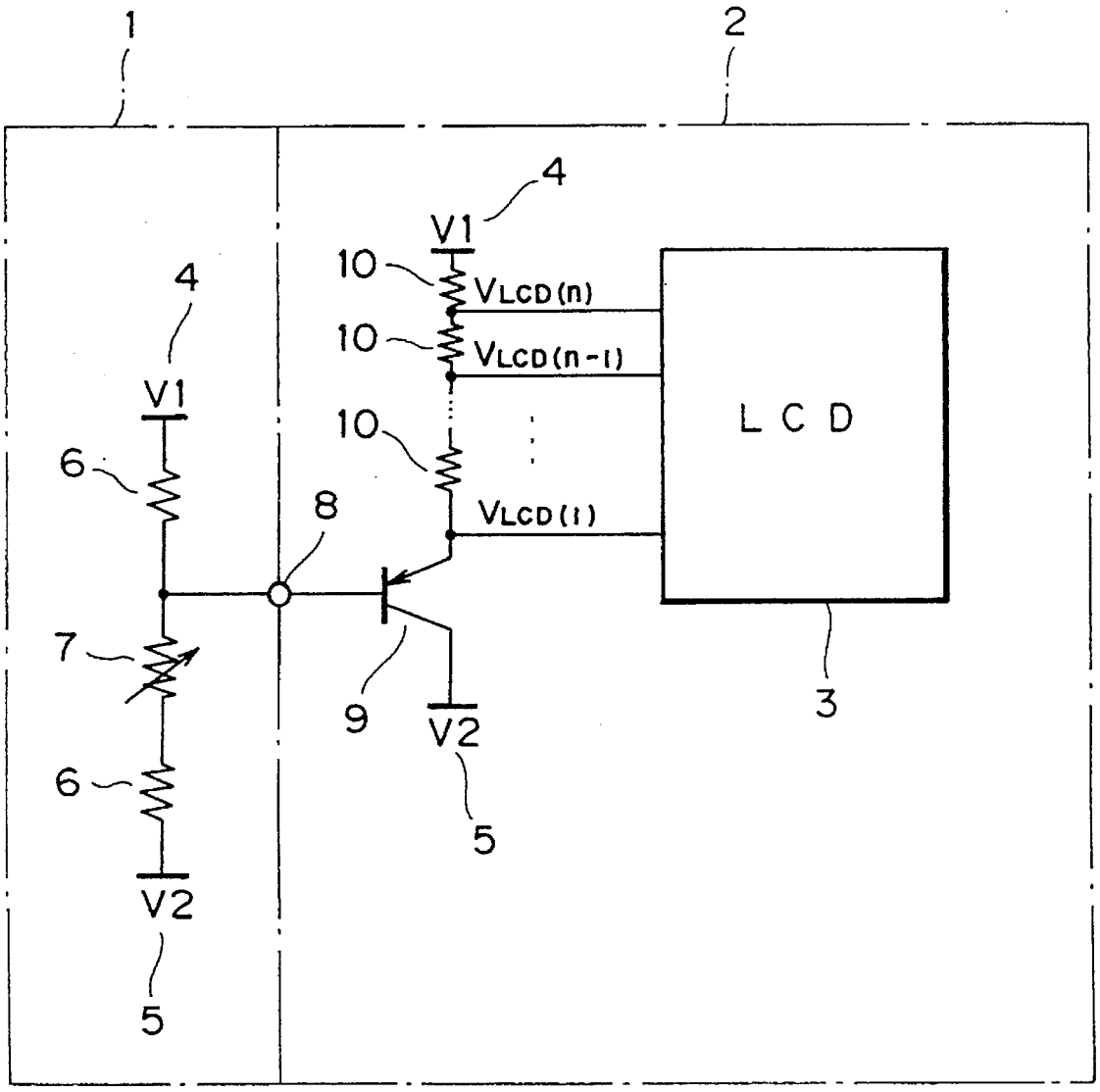
FIG. 1 PRIOR ART
FIG. 1 is a circuit diagram showing the construction of a prior art.
Figure 2:
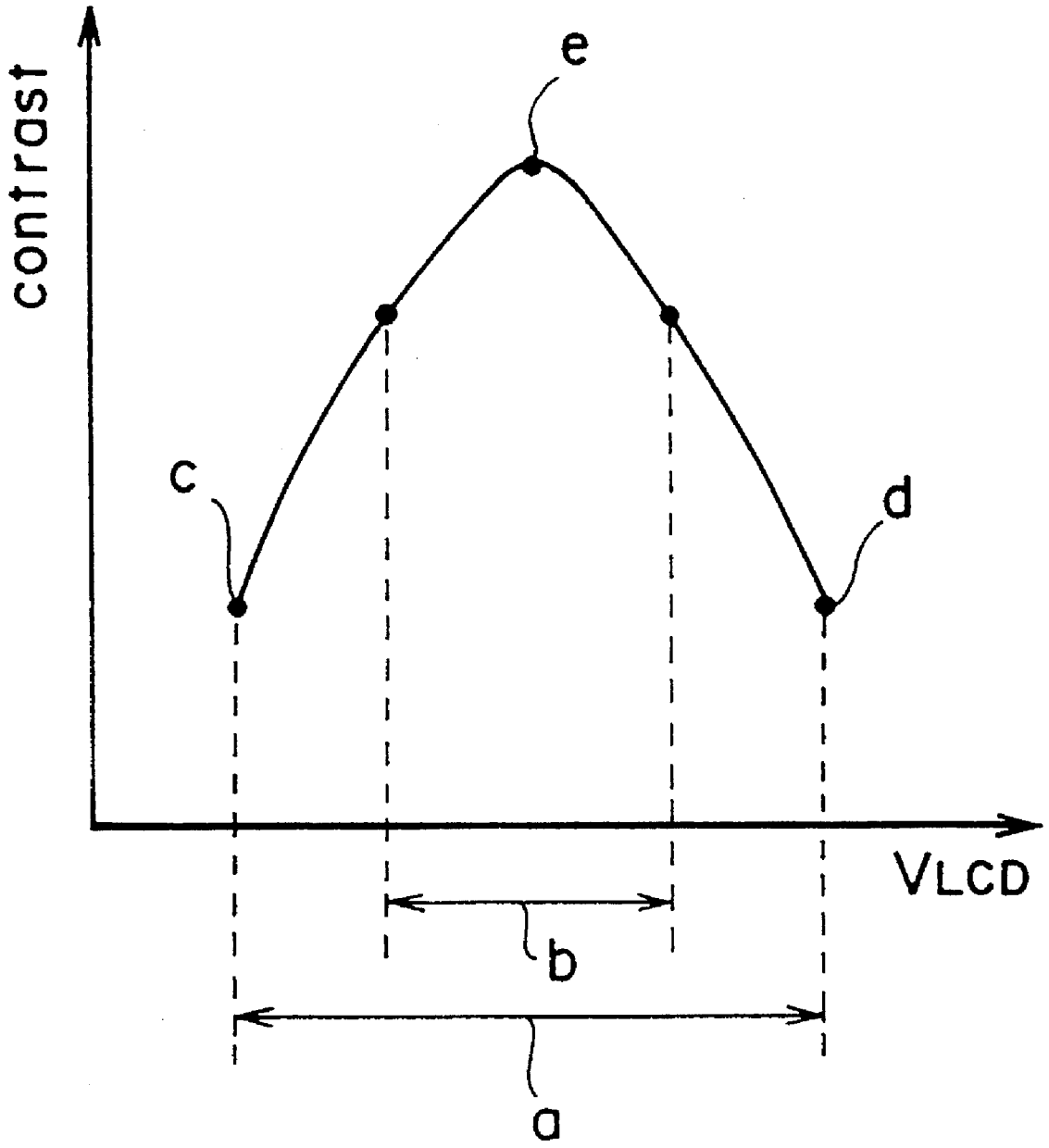
FIG. 2 is a diagram illustrating the relationship between the driving voltage and the contrast of a liquid crystal display.
Figure 3:
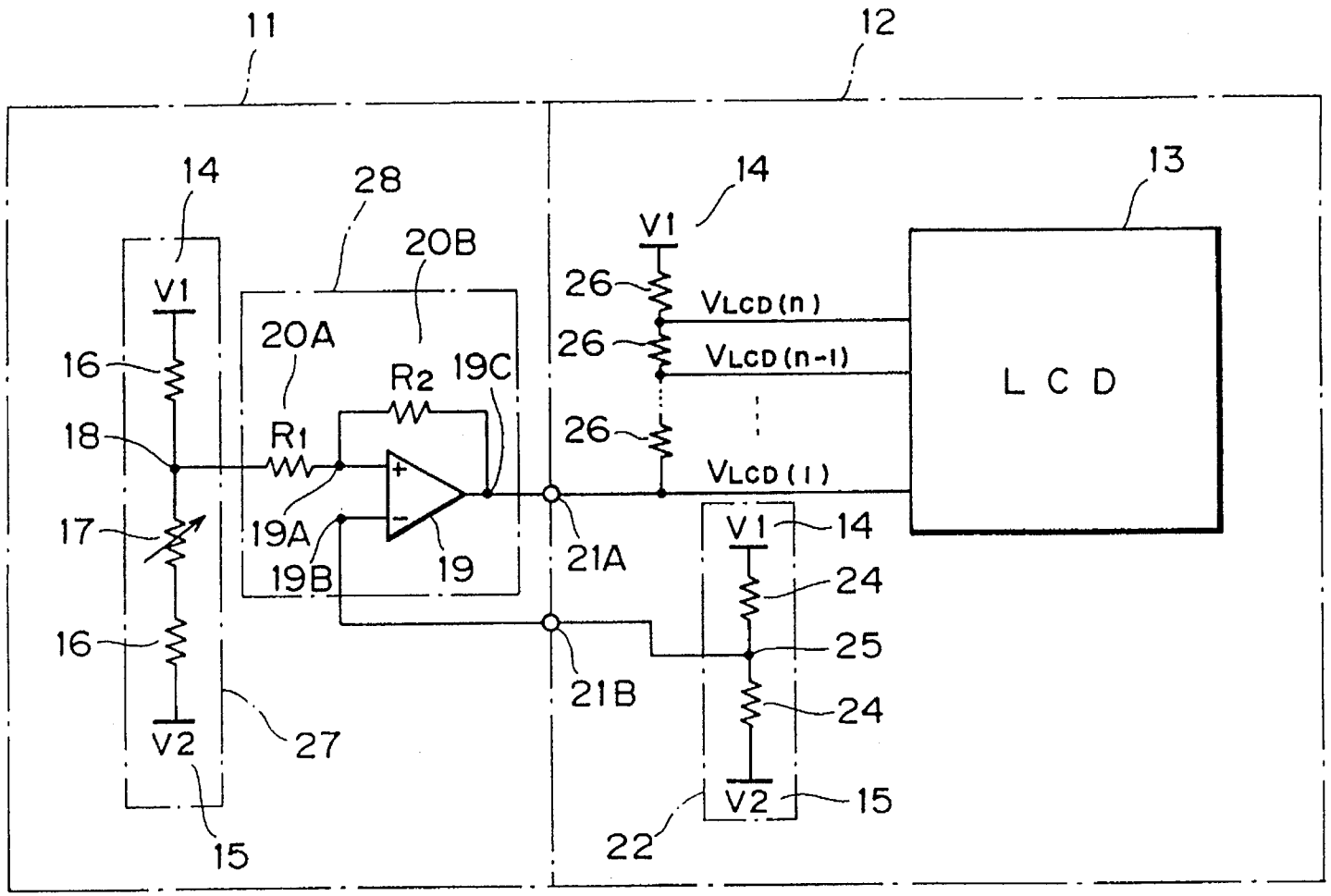
FIG. 3 is a circuit diagram showing the construction of a first embodiment of the present invention.

FIG. 3 is a circuit diagram showing the circuit construction of a first embodiment of the present invention. Referring to FIG. 3, reference numeral 11 denotes an electronic apparatus such as a computer, and 12 a liquid crystal display module (LCD module) having an LCD panel 13. The electronic apparatus 11 includes a first power source (V1) 14 and a second power source (V2) 15 which are connected to each other by way of a plurality of voltage dividing resistors 16, 16 and 17. The resistor 17 is formed as a variable resistor so that, by finely adjusting the variable resistor 17, the voltage to be outputted from an output terminal 18 can be adjusted within a predetermined range (for example, ±2 V).

The electronic apparatus 11 further includes an operational amplifier 19 having a positive phase input terminal (non-inverted input terminal) 19A, a reverse phase input terminal (inverted input terminal) 19B, and an output terminal 19C. The positive phase input terminal 19A of the operational amplifier 19 and the output terminal 18 at an end of the variable resistor 17 are connected to each other by way of a first resistor (R1) 20A, and the positive phase input terminal 19A and the output terminal 19C are connected to each other by way of a second resistor (R2) 20B. The output terminal 19C of the operational amplifier 19 is connected to a first connection terminal 21A connected to the liquid crystal display module 12, and the reverse phase input terminal 19B is connected to a second connection terminal 21B connected to the liquid crystal display module 12.

The liquid crystal display module 12 includes a reference voltage supply circuit 22 which includes a plurality of voltage dividing resistors 24 connected between the first power source (V1) 14 and the second power source (V2) 15 both supplied from the electronic apparatus 11, and an output terminal 25 between the resistors 24 is connected to the second connection terminal 21B. The first power source 14 may be omitted while a plurality of voltage dividing resistors 24 are connected between the ground and the second power source (V2) 15 instead. The resistors 24 have resistance values set so that the voltage at the output terminal 25 may be equal in absolute value to the contrast peak voltage of the LCD panel 13 employed by the liquid crystal display module 12.

The first connection terminal 21A connected to the electronic apparatus 11 is connected to a corresponding one (first driving voltage input terminal) of a plurality of driving voltage input terminals of a control IC (not shown) of the LCD panel 13, and the first driving voltage input terminal is connected to the first power source (V1) 14 supplied from the electronic apparatus 11 by way of a plurality of voltage dividing resistors 26. Also output terminals at one ends of the individual voltage dividing resistors 26 are individually connected to corresponding ones (second, . . . , n−1th and nth driving voltage input terminals) of the driving voltage input terminals of the control IC. Driving voltages $V_{LCD(1)}$, . . . , $V_{LCD(n-1)}$ and $V_{LCD(n)}$ are selectively supplied to the electrodes (transparent conductive films) of the LCD panel 13 under the control of the control IC.

It is to be noted that a contrast adjustment circuit is constituted from the first power source 14, the second power source 15, the voltage dividing resistors 16, 16 and 17 including the variable resistor 17, the first resistor 20A, the second resistor 20B and the operational amplifier 19 provided in the electronic apparatus 11 and the reference voltage generation circuit 22 provided in the liquid crystal display module 12. Further, an adjustment voltage supply circuit 27 is constituted from the first power source 14, the second power source 15, and the voltage dividing resistors 16, 16 and 17 including the variable resistor 17, and an operational amplification circuit 28 is constituted from the operational amplifier 19, the first resistor 20A and the second resistor 20B.

Thus, a reference voltage is supplied from the output terminal 25 of the reference voltage generation circuit 22 to the reverse phase input terminal 19B of the operational amplifier 19 by way of the second connection terminal 21B. Meanwhile, a predetermined voltage adjusted within ±2 V by the variable resistor 17 is supplied to the positive phase input terminal 19A of the operational amplifier 19 by way of the first resistor 20A. Consequently, the driving voltage $V_{LCD}$ to be supplied to the LCD panel 13 can be adjusted within the range of ±2 V with reference to the contrast peak voltage (for example, −20 V) of the LCD panel 13.

Then, where the contrast peak voltage of the LCD panel 13 of the liquid crystal display module 12 employed is, for example, −18 V, the reference voltage generation circuit 22 is constructed so that the reference voltage thereof is +18 V. Consequently, the driving voltage $V_{LCD}$ adjusted within the range of ±2 V with reference to −18 V is supplied to the LCD panel 13 without modifying the circuit construction of the electronic apparatus 11 at all. Accordingly, the contrast can always be adjusted within the range conforming to the contrast peak voltage of the liquid crystal display employed irrespective of the contrast peak voltage without modifying the circuit construction of the electronic apparatus 11. It is to be noted that the range of adjustment of the contrast can be varied arbitrarily by varying the resistance values of the first and second resistors 20A and 20B. This allows better contrast adjustment.

Figure 4:
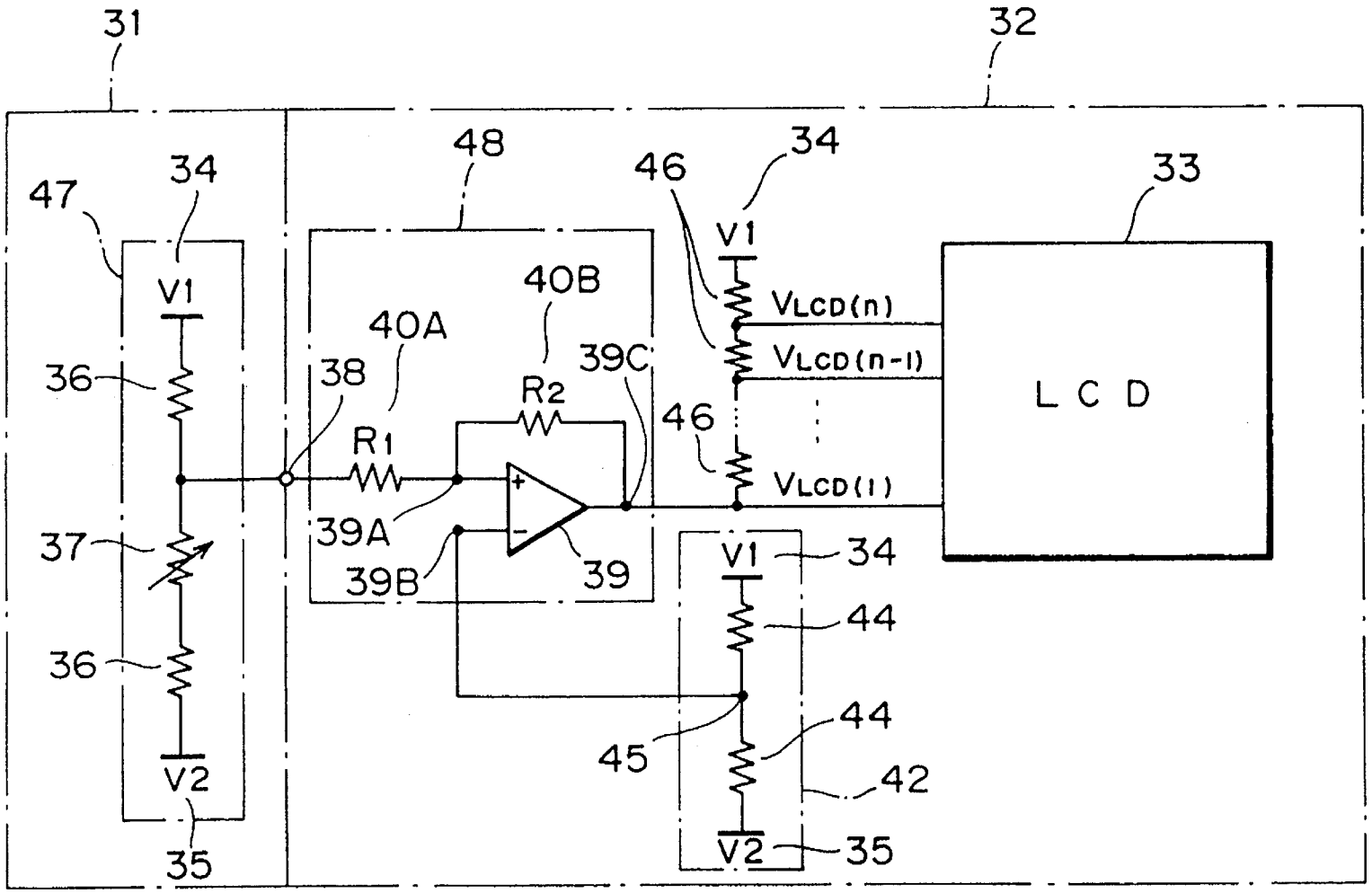
FIG. 4 is a circuit diagram showing the construction of a second embodiment of the present invention.

FIG. 4 is a circuit diagram showing the circuit construction of a second embodiment of the present invention. Referring to FIG. 4, reference numeral 31 denotes an electronic apparatus such as a computer, and 32 a liquid crystal display module (LCD module) including an LCD panel 33. The electronic apparatus 31 includes a first power source (V1) 34 and a second power source (V2) 35 which are connected to each other by way of a plurality of voltage dividing resisters 36, 36 and 37. The resistor 37 is formed as a variable resistor, and an end of the resistor 37 is connected as an output terminal to a connection terminal 38 to the liquid crystal display module 32. The voltage to be supplied to the connection terminal 38 to the liquid crystal display module 32 can be adjusted within a predetermined range (for example, +2 V) by finely adjusting the variable resistor 37.

The liquid crystal display module 32 includes an operational amplifier 39 having a positive phase input terminal (non-inverted input terminal) 39A, a reverse phase input terminal (inverted input terminal) 39B and an output terminal 39C. The positive phase input terminal 39A of the operational amplifier 39 and the connection terminal 38 are connected to each other by way of a first resistor (R1) 40A, and the positive phase input terminal 39A and the output terminal 39C are connected to each other by way of a second resistor (R2) 40B.

The liquid crystal display module 32 further includes a reference voltage supply circuit 42 constituted from a plurality of voltage dividing resistors 44 connected between the first power source (V1) 34 and the second power source (V2) 35 both supplied from the electronic apparatus 31, and an output terminal 45 between the resistors 44 is connected to the reverse phase input terminal 39B of the operational amplifier 39. The first power source 34 may be omitted while a plurality of voltage dividing resistors 44 are connected between the ground and the second power source (V2) 35 instead. The resistors 44 have resistance values set so that the voltage at the output terminal 45 may be equal in absolute value to the contrast peak voltage of the LCD panel 33 employed by the liquid crystal display module 32.

The output terminal 39C of the operational amplifier 39 is connected to a corresponding one (first driving voltage input terminal) of a plurality of driving voltage input terminals of a control IC (not shown) of the LCD panel 33, and the first driving voltage input terminal is connected to the first power source (V1) 34 supplied from the electronic apparatus 31 by way of a plurality of voltage dividing resistors 46. Also output terminals at one ends of the individual voltage dividing resistors 46 are connected to corresponding ones (second, . . . , n−1th and nth driving voltage input terminals) of the driving voltage input terminals of the control IC. Driving voltages $V_{LCD(1)}$, . . . , $V_{LCD(N-1)}$ and $V_{LCD(n)}$ are selectively supplied to the electrodes (transparent conductive films) of the LCD panel 33 under the control of the control IC.

It is to be noted that a contrast adjustment circuit is constituted from the first power source 34, the second power source 35 and the voltage dividing resistors 36, 36 and 37 including the variable resistor 37 all provided in the electronic apparatus 31, and the first resistor 40A, the second resistor 40B, the operational amplifier 39 and the reference voltage generation circuit 42 provided on the liquid crystal display module 32. Meanwhile, an adjustment voltage supply circuit 47 is constituted from the first power source 34, the second power source 35 and the voltage dividing resistors 36, 36 and 37 including the variable resistor 37, and an operational amplification circuit 48 is constituted from the operational amplifier 39, the first resistor 40A and the second resistor 40B.

Thus, a reference voltage is supplied from the output terminal 45 of the reference voltage generation means 42 to the reverse input terminal 39B of the operational amplifier 39, and a predetermined voltage which is adjusted within the range of ±2 V by the variable resistor 37 is supplied to the positive phase input terminal 39A of the operational amplifier 39 by way of the connection terminal 38 and the first resistor 40A. Consequently, the driving voltage $V_{LCD}$ to be supplied to the LCD panel 33 can be adjusted within the range of ±2 V with reference to the contrast peak voltage (for example, −20 V) of the LCD panel 33.

Where the contrast peak voltage of the LCD panel 33 of the liquid crystal display module 32 adopted is, for example, −22 V, if the reference voltage generation circuit 42 is constructed so that the reference voltage may be +22 V, then the driving voltage $V_{LCD}$ which is adjusted within the range of ±2 V with reference to −22 V is supplied to the LCD panel 33 without modifying the circuit construction of the electronic apparatus 31. Accordingly, the contrast can always be adjusted within the range conforming to the contrast peak voltage of the liquid crystal display module 32 adopted irrespective of the contrast peak voltage without modifying the circuit construction of the electronic apparatus 31.

According to the second embodiment described above, the construction of the electronic apparatus 31 side of the contrast adjustment circuit is the same as the construction described hereinabove as the prior art, and accordingly, optimum adjustment of the contrast can be performed only on the liquid crystal display module 32 side. It is to be noted that the range of adjustment of the contrast can be changed arbitrarily by varying the resistance values of the first and second resistors 40A and 40B, and this allows further good contrast adjustment.

Since the present invention is constructed in such a manner as described above, there is an advantage in that a contrast adjustment circuit which can flexibly cope with a liquid crystal display module adopted irrespective of the contrast peak voltage of the liquid crystal display module and always allows optimum contrast adjustment to be provided.

What is claimed is:

1. A contrast adjustment circuit for a liquid crystal display connected to an electronic apparatus when used, said liquid crystal display having a driving voltage input terminal, comprising:

adjustment voltage supply means provided in said electronic apparatus and having voltage adjustment means for finely adjusting an adjustment voltage to be outputted;

reference voltage generation means provided in said liquid crystal display for generating a reference voltage substantially equal in absolute value to a contrast peak voltage of said liquid crystal display, the reference voltage being capable of being adjusted in response to the contrast peak voltage of said liquid crystal display; and operational amplification means for comparing the reference voltage and the adjustment voltage and applying a voltage difference between the reference voltage and the adjustment voltage to said driving voltage input terminal of said liquid crystal display, said operational amplification means having a reverse phase input terminal to which the reference voltage from said reference voltage generation means is applied and a positive phase input terminal to which the adjustment voltage from said adjustment voltage supply means is applied.

2. A contrast adjustment circuit for a liquid crystal display according to claim 1, wherein said adjustment voltage supply means includes a first power source, a second power source having a potential different from that of said first power source, and a plurality of voltage dividing resistors connected in series between said first and second power sources, and said voltage adjustment means includes a variable resistor.

3. A contrast adjustment circuit for a liquid crystal display according to claim 1, wherein said reference voltage generation means includes a first power source, a second power source having a potential different from that of said first power source, and a plurality of voltage dividing resistors connected in series between said first and second power sources.

4. A contrast adjustment circuit for a liquid crystal display according to claim 1, wherein said operational amplification means includes an operational amplifier, a first resistor connected between a positive phase input terminal of said operational amplifier and an output terminal of said adjustment voltage supply means, and a second resistor connected between the positive phase input terminal and an output terminal of said operational amplifier.

5. A contrast adjustment circuit for a liquid crystal display according to claim 1, wherein said operational amplification means is provided in said electronic apparatus.

6. A contrast adjustment circuit for a liquid crystal display according to claim 1, wherein said operational amplification means is provided in said liquid crystal display.

7. A contrast adjustment circuit for a liquid crystal display connected to an electronic apparatus when used, said liquid crystal display having a driving voltage input terminal, comprising:

adjustment voltage supply means provided in said electronic apparatus for supplying an adjustment voltage, said adjustment voltage supply means including a first power source, a second power source having a potential different from that of said first power source, and a variable resistor connected between said first and second power sources;

reference voltage generation means provided in said liquid crystal display for generating a reference voltage substantially equal in absolute value to a contrast peak voltage of said liquid crystal display, the reference voltage being capable of being adjusted in response to the contrast peak voltage of said liquid crystal display;

an operational amplifier having a reverse phase input terminal to which the reference voltage from said reference voltage generation means is applied, a positive phase input terminal to which the adjustment voltage from said adjustment voltage supply means is applied, and an output terminal to which said driving voltage input terminal of said liquid crystal display is connected;

a first resistor connected between said positive phase input terminal of said operational amplifier and an end of said variable resistor; and a second resistor connected between said positive phase input terminal and an output terminal of said operational amplifier.

* * * * *